United States Patent [19]

Turk

[11] Patent Number: 4,854,898

[45] Date of Patent: Aug. 8, 1989

[54] ELECTRICAL CONNECTOR

[75] Inventor: Frederick J. Turk, St. Paul, Minn.

[73] Assignee: Minnesota Mining and Manufacturing Company, St. Paul, Minn.

[21] Appl. No.: 153,239

[22] Filed: Feb. 8, 1988

[51] Int. Cl.[4] ..... H01R 11/09

[52] U.S. Cl. ..... 439/723; 439/787

[58] Field of Search ..... 439/436–439, 439/441, 721, 723, 786, 787, 816, 834, 860–862

[56] References Cited

U.S. PATENT DOCUMENTS

| | | | |
|---|---|---|---|
| 3,019,406 | 1/1962 | Slater | 439/439 |
| 3,189,863 | 6/1965 | Leach | 339/99 |
| 3,590,387 | 6/1971 | Landis | 439/860 |
| 3,638,171 | 1/1972 | Hulbrechtse | 339/164 R |
| 3,665,373 | 5/1972 | Voglesonger | 339/95 D |
| 3,918,790 | 11/1975 | Filson | 439/860 |
| 3,945,709 | 3/1976 | Filson | 439/860 |
| 3,945,711 | 3/1976 | Hohorst et al. | 339/95 D |
| 4,056,299 | 11/1977 | Paige | 339/95 D |
| 4,212,507 | 7/1980 | Bunnell | 339/18 B |
| 4,217,021 | 8/1980 | Illum | 339/95 D |
| 4,410,228 | 10/1983 | Stephenson | 439/436 |
| 4,585,902 | 4/1986 | Munroe | 174/87 |

FOREIGN PATENT DOCUMENTS

| | | | |
|---|---|---|---|
| 2095925 | 10/1982 | United Kingdom | 439/436 |

*Primary Examiner*—Neil Abrams

*Attorney, Agent, or Firm*—Donald M. Sell; Walter N. Kirn; Leland D. Schultz

[57] ABSTRACT

A push-in type electrical connector including an electrically insulating body having a plurality of passageways for receiving wires. An electrically conductive contact includes a main portion mounted in the body and a plurality of resilient arm portions each extending from the main portion into one of the passageways and lying in a common plane generally transverse to the passageways. When a wire is inserted into a passageway, the arm portion is deflected by the wire within the common transverse plane and resiliently contacts and grips the wire.

2 Claims, 2 Drawing Sheets

ELECTRICAL CONNECTOR

TECHNICAL FIELD

This invention relates generally to electrical connectors and more particularly to push-in electrical connectors.

BACKGROUND ART

In branch wiring of electrical circuits, it is common to electrically interconnect two or more wires. Individual wires may be bent about a screw type conductive stud, with the stud tightened about the wires. Other electrical connectors employed in the past have included "spring" type connectors in which the exposed ends of the wires are twisted together and inserted into a common cavity within an insulating body. A spring or coil is mounted within the common cavity and secures the twisted ends of the wires within the connector and ensures common electrical interconnection between the wires.

U.S. Pat. No. 3,638,171, issued to Hulbrechtse, is an example of a "push-in" type connector incorporated into an electrical outlet. The push-in connector includes individual passageways for insertion of the exposed end of a wire. An electrically conductive beam member is mounted within the passageway for sliding contact with the wire within the passageway. As the wire encounters the beam member, the beam member is deflected at one end away from the longitudinal axis of the passageway and is resiliently urged into electrical contact with the wire. Although push-in connectors are faster and easier to use than "spring" type connectors, they are substantially more expensive to construct and, therefore, their use has been limited.

SUMMARY OF THE INVENTION

This invention provides a push-in electrical conductor that is inexpensive, easy to manufacture and enables a plurality of wires to be quickly and easily interconnected.

An electrical connector is provided for electrically interconnecting a plurality of wires, and includes an electrically insulating body having a plurality of parallel passageways, each adapted to receive a portion of one wire. An electrically conductive resilient contact is provided having first and second opposite major surfaces and a peripheral edge surface around the major surfaces. The contact has in the plane of the major surfaces a main portion and a plurality of arm portions projecting from the main portion. Camming surfaces are provided in opposed pairs on the peripheral edge surface of the contact for each wire, normally spaced at a distance less than the diameter of the wires to be connected. At least one of each pair of opposed camming surfaces is located on the peripheral edge of an arm portion. The contact is mounted in the body with the major surfaces generally transverse to said passageways. Each of the opposed pairs of camming surfaces is aligned with a different one of the passageways. Each of the opposed pairs of camming surfaces is oriented so that engagement of the end of one of the wires with the camming surfaces in a direction at a right angle to the major surfaces will resiliently bend the adjacent arm portion away from the opposite camming surface in a direction generally parallel to the major surfaces to afford movement of the wire between the opposed pair of camming surfaces and provide spring biased electrical and mechanical engagement between the contact and the wire.

BRIEF DESCRIPTION OF THE DRAWING

The present invention will be further described with reference to the accompanying drawing wherein like reference numerals refer to like parts in the several views, and wherein.

DESCRIPTION OF THE PREFERRED EMBODIMENTS

Figure 1:
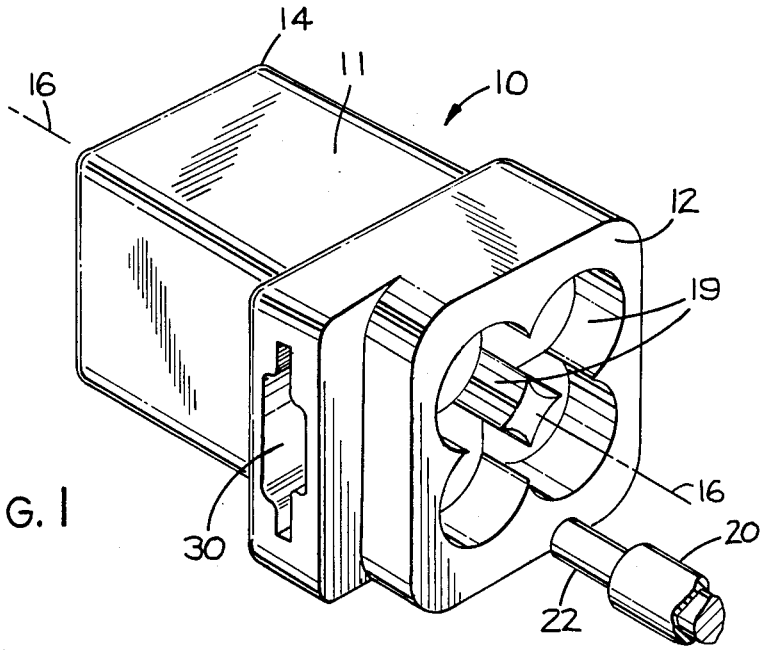
FIG. 1 is an isometric view of a push-in connector constructed according to this invention.
Figure 2:
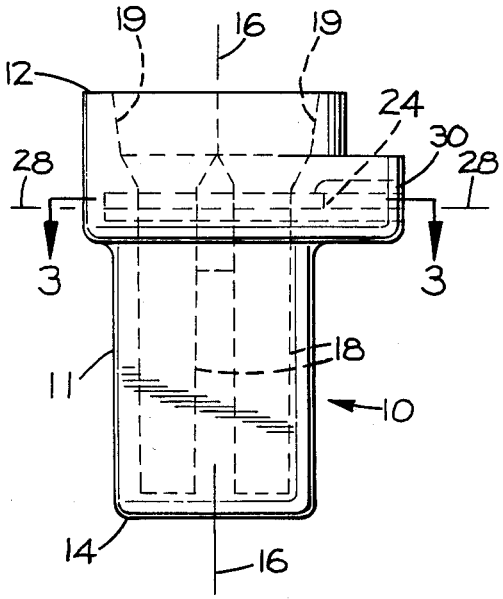
FIG. 2 is a top view of the push-in electrical connector of FIG. 1.
Figure 3:
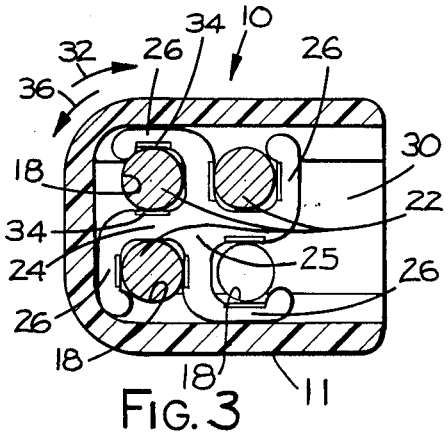
FIG. 3 is a cross sectional view taken generally along plane 3—3 of FIG. 2 illustrating engagement of a contact of the connector with three wires inserted into the connector.

Referring now to FIGS. 1–3, the reference numeral 10 generally indicates an electrical connector constructed according to the present invention. The connector includes a body 11 constructed of electrically insulating material. Preferably, the connector body 11 is molded from a thermoplastic material such as polyvinyl chloride, nylon or polypropylene. The connector body 11 includes a first end 12, a second end 14, and a longitudinal axis 16 extending through the body between the first and the second ends. A plurality of parallel sockets or passageways 18 extend into the body 11, generally parallel to the longitudinal axis 16, each from an opening 19 at the first end 12. Each of the passageways 18 is adapted for receipt of an exposed end portion 22 of wire 20, guided by constructing frusto-conical openings 19 as shown. Although not shown, it is within the scope of this invention to provide passageways 18 that extend all the way through body 11, enabling insertion of a wire into either end 12 or 14 of the body.

Electrically conductive contact 24 includes opposing major surfaces and a peripheral edge surface defining a main portion 25 of the contact and a plurality of resilient arm portions 26 projecting from the main portion. The arm portions 26 lie between the major surfaces in a common plane 28 generally transverse to the passageways 18 when the contact is mounted within the connector body. It is one of the primary advantages of this invention that the contact 24 is economical to produce, such as by blanking.

Each of the arm portions extends into one of the passageways 18 when contact 24 is mounted in the connector body. Although the contact 24 may be molded in place within the body 11 of the connector, in the preferred embodiment of the invention a transverse slot 30 is formed in the connector body to enable the contact to be inserted into the connector body 11 and frictionally retained therein.

A plurality of pairs of camming surfaces 34 are formed on opposing parts of the peripheral edge surface of the contact, each pair of camming surfaces for sliding engagement with the end of a wire and each pair of opposing camming surfaces normally spaced at a distance less than the diameter of the wires to be connected. At least one of each pair of opposing camming surfaces is formed on the peripheral edge surface of an arm portion 26. When the end portion 22 of wire 20 is inserted into a passageway 18, the end of the wire encounters one of the opposing pairs of camming surfaces 34 in a direction generally at right angles to the major surfaces of the contact. The arm portion 26 is deflected away from the opposite camming surface in rotational direction 32. All of the movement of the arm portions 26 lies within the common transverse plane 28 between the major surfaces of the contact. The arm portion is resiliently urged back in the opposite rotational direction 36 towards its relaxed position into secure electrical contact with the exposed end portion 22 of the wire 20. Therefore, electrical interconnection is established by contact 24 between all wires inserted into the connector. Simultaneously, the wires are gripped by the contact so as to mechanically retain the wire in engagement within the connector. If desired, the wires may each be independently pulled from the passageway without damage to the wire or to the contact.

Figure 4:
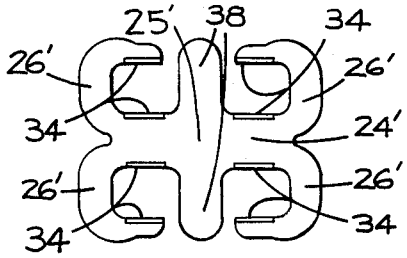
FIG. 4 is a plan view of an alternate embodiment of the contact that could be used in the connector of FIG. 1.

FIG. 4 illustrates an alternative arrangement for the contact 24', with the arms 26' arranged in two spaced pairs and with a pair of intermediate flanges 38 projecting from the main portion 25' of the contact for more securely engaging the wire within the connector.

Figure 5:
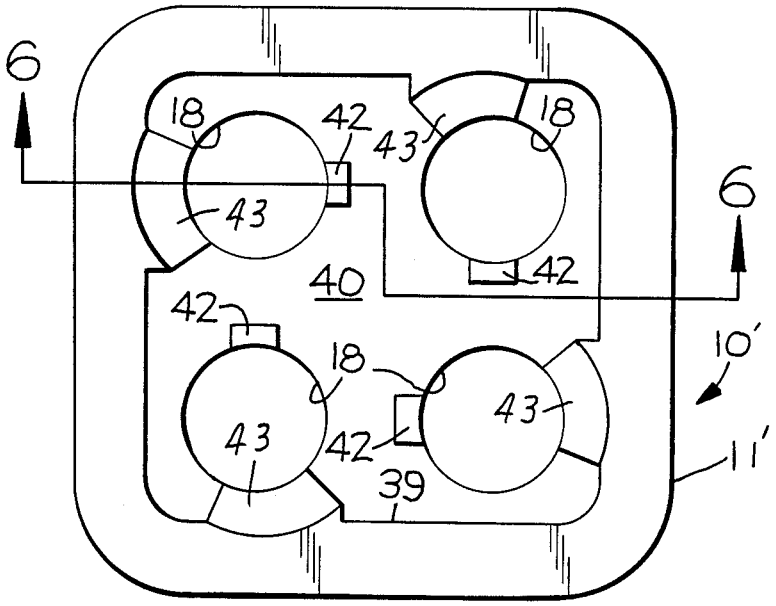
FIG. 5 is an end view of an alternative embodiment of the connector body of FIG. 1 in which a contact is inserted through a common opening in an end of the connector body.
Figure 6:
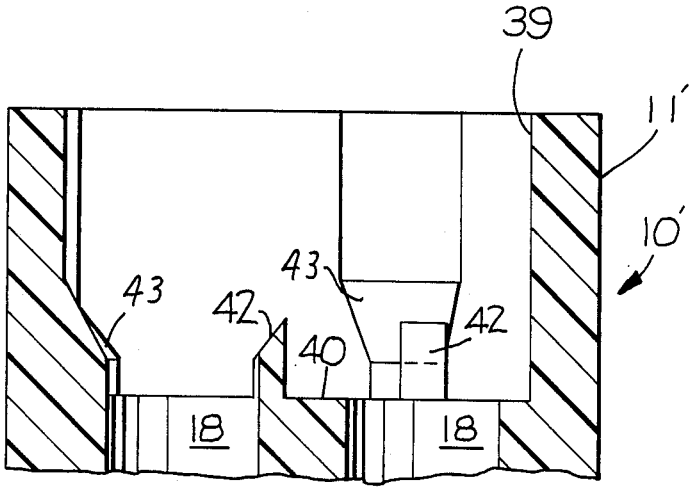
FIG. 6 is a partial cross-sectional view along plane 6—6 of the connector body of FIG. 5.

FIGS. 5 and 6 illustrate yet another alternative embodiment 10' of the connector of this invention in which a common opening 39 is formed in the front end 12 of connector body 11'. A contact (such as shown in FIG. 3) is mounted in the body 11', by insertion in a longitudinal direction into common opening 39. The contact is mounted against wall 40. Tapered tabs 42 are provided along with opposing concave surfaces 43 for each passageway 18 to guide the end portion 22 of each wire 20 as it is inserted into the passage.

In all other respects, these embodiments of the invention are as hereinabove described.

The present invention has now been described with reference to three embodiments thereof. It will be apparent to those skilled in the art that many changes can be made in the embodiments described without departing from the scope of the present invention. Thus the scope of the present invention should not be limited to the structures described in this application, but only by structures desribed by the language of the claims and the equivalents of those structures.

I claim:

1. An electrical connector for electrically interconnecting a plurality of wires, said connector comprising:

an electrically insulating body having a plurality of parallel passageways, each of said passageways adapted to receive a portion of one wire; and an electrically conductive resilient contact having first and second opposite major surfaces and a peripheral edge surface around said major surfaces, said contact having between said major surfaces a main portion and a plurality of arm portions projecting from said main portion, said contact further including a plurality of pairs of opposing camming surfaces formed on said peripheral edge surface with each pair normally spaced at a distance less than the diameter of the wires to be connected, to enable sliding engagement with one of the wires and at least one of each said pair of opposing camming surfaces located on the peripheral edge surface of an arm portion, said contact being mounted in said body with said major surfaces generally transverse to said passageways and each of said pair of opposed camming surfaces aligned with a different one of said passageways and oriented so that engagement of the end of one of the wires with the camming surfaces in a direction at a right angle to said major surfaces will resiliently bend the adjacent arm portion away from the opposite camming surface in a direction generally parallel to said major surfaces to afford movement of the wire between said opposed camming surfaces of said peripheral edge surface and provide spring biased electrical and mechanical engagement between said contact and the wire.

2. The electrical connector of claim 1, further including a slot formed in said connector body generally transverse to said passageways for mounting said contact within said connector body.

* * * * *